US005923321A

United States Patent [19]

Huang

[11] Patent Number: 5,923,321

[45] Date of Patent: Jul. 13, 1999

[54] STRUCTURAL GRAPH DISPLAY SYSTEM

[75] Inventor: Yi-Hui Huang, Taipei Hsien, Taiwan

[73] Assignee: Arphic Technology Co., Ltd., Taipei, Taiwan

[21] Appl. No.: 08/871,000

[22] Filed: Jun. 6, 1997

Related U.S. Application Data

[51] Int. Cl.[6] ..... G09G 5/22

[52] U.S. Cl. ..... 345/192; 345/141; 345/194; 345/467

[58] Field of Search ..... 345/192, 194, 345/469, 470, 471, 141, 467

[56] References Cited

U.S. PATENT DOCUMENTS 4,990,903 2/1991 Cheng et al. ..... 345/471
5,852,448 12/1998 Cheng ..... 345/469

*Primary Examiner*—Kee M. Tung

*Attorney, Agent, or Firm*—Winston Hsu

[57] ABSTRACT

The present invention provides a structural graph display system which utilizes index tables and index numbers to replace repeatedly occurred graphic parameters stored in a graphic description file so that overall memory requirement for storing the graphic description file can be substantially reduced. Within the graphic description file, a plurality of structural graphs are stored. Each structural graph comprises at least one sub-graph and each sub-graph contains a plurality of sub-graph parameters for drawing the sub-graph within a target area. One of the sub-graph parameters is defined as a target parameter. An index table of the target parameter is stored in the system which comprises a set of frequently used target parameters, an index number for each frequently used target parameter, and a special index number. In the graphic description file, each target parameter is changed according to the following rule: if the target parameter is one of the frequently used target parameters in the index table, it is replaced by a correspondent index number, or else it is replaced by the special index number plus the target parameter.

20 Claims, 7 Drawing Sheets

STRUCTURAL GRAPH DISPLAY SYSTEM

BACKGROUND OF THE INVENTION

1. Field of the Invention

The present invention relates to a structural graph display. system, and more particularly, to a structural graph display system which utilizes index tables to reduce memory space needed for storing graphic information.

2. Description of Prior Art

High quality Chinese character generators commonly use a character generation technique which generates a character by generating all the strokes of the character one by one. Such character generation technique treats a Chinese character as a structural graph which comprises at least one stroke as its sub-graph. Each character may contain many strokes, depending on the complexity of each character. And each stroke of a Chinese character is represented by the contour of the stroke which is generated by a stroke generation program of the stroke.

When drawing a stroke in a rectangular area such as a 256 by 256 bit map to form a character, several stroke parameters must be provided: a stroke ID (identification), a predetermined number of control points which are represented as (x,y) coordinates within the rectangular area, and a predetermined number of stroke widths which are the widths of several predetermined locations of the stroke contour. Stroke ID is used for initiating a specific stroke program which will draw the stroke within the rectangular area according to the provided control points and width(s). A stroke program is written in a graphic description language. When all the strokes of a character are drawn into the rectangular area one by one in a predetermined sequence, the character is formed.

The total number of stroke types, which is represented as the. stroke IDs, for generating all the Chinese characters may around 70 in some commercial products which is not big when comparing with the number of Chinese characters provided by a Chinese character generator. A commercially available Chinese character generator may provide up to 14,000 Chinese characters. The number of stroke IDs may be changed by the manufacturer of each Chinese character generator, depending on how they classify all the strokes of Chinese characters. For each stroke ID, a correspondent stroke program is provided for generating the specific stroke according to the predetermined numbers of control points and stroke widths. The locations of the control points and the values of the stroke widths of a specific stroke may vary depending on the location of the stroke within a character and also depending on the artistic look of the character so that the length, thickness, and angle of the stroke may look differently. Different character fonts usually have quite different stroke contours. However, the number of control points and widths of a specific stroke can not be changed or else it couldn't be generated by the correspondent stroke program.

Please refer to FIG. 1. FIG. 1 shows a prior art stroke table 10. Stroke table 10 contains a stroke ID 14 for each stroke and a stoke program 12 for drawing each stoke in a rectangular area. When drawing a stroke, the stroke program 12 of the stroke will be initiated according to the stroke ID 14.

Please refer to FIG. 2 and FIG. 3. FIG. 2 shows the contour of a stroke 20 with its control points (X1, Y1) and (X2, Y2), and stroke width W1. FIG. 3 shows a stroke array 30 of the stroke 20 which comprises a stroke ID (ID2), the control points' coordinates X1, Y1, X2, and Y2 and stroke width W1. The number of control points and stroke width(s) contained in a stroke array may vary depending on the type of stroke ID. Certain stroke ID may contain up to five control points and three or four stroke widths.

Please refer to FIG. 4 and 5. FIG. 4 shows a character 48 which contains three strokes 40, 42 and 44. FIG. 5 shows a character array 50 of the character 48 which comprises three stroke arrays 52, 54 and 56 corresponding to the three strokes 40, 42 and 44, separately. The three stroke arrays 52, 54 and 56 are arranged in the character array 50 according to a predetermined drawing sequence which is similar to the hand-writing sequence of the character 48.

Please refer to FIG. 6. FIG. 6 shows a prior art character description file 60 which contains all the character arrays for all the characters provided by a prior art character generator. The character description file 60 comprises an address table 62 and a character array 64 for each character. The address table 62 contains a word ID (WID) for each character and the address of the corresponding character array 64. The data format of the character array 64 is the same as the character array 50 shown in FIG. 5 which comprises a sequence of stroke arrays of the correspondent character. When drawing a character by using a prior art character generator, it will first locate the character array 64 of the character by using the address table 62, and then draw all the strokes of the character one by one by using the located character array 64 and the stroke programs 12 stored in the stroke table 10 shown in FIG. 1 and within a rectangular area.

The above mentioned prior art character description file 60 has one problem: it requires a lot of memory space to store it. Take the character array 50 shown in FIG. 5 as an example, each stroke ID takes eight bits, and each X or Y coordinate or stroke width also takes eight bits. Totally it requires 48 bits for a very simple stroke. The number of Chinese characters in a commercially available Chinese character generator is approximately around 14,000. And a lot of characters contains eight or more strokes. A typical character description file requires about 1.5 MB (mega-byte) memory space. Such memory requirement is not a big problem when stored in a hard disk of a personal computer, but for those small electronic systems such as pager, hand-held calculator or personal organizer, etc., such memory requirement is a big problem especially multiple character fonts are required.

Most of these small electronic systems use ROM (read only memory) for storing the character description files. One character description file is needed for one character font. And vendors of small electronic systems usually prefer to put three or four different character fonts in a system so that the characters displayed in such a system may have a lot of variations. Total memory space for four character fonts may take more than 6 MB. It is very difficult for small electronic systems to provide such memory space.

SUMMARY OF THE INVENTION

It is therefore a primary objective of present invention to provide a structural graph display system which utilizes index tables to reduce memory space needed for storing graphic information.

Briefly, in a preferred embodiment, the present invention includes a structural graph display system comprising a memory for storing programs and data, a processor for executing the programs stored in the memory, and a predetermined area for displaying a structural graph. Each structural graph is formed by at least one sub-graph. And each sub-graph comprises a plurality of sub-graph parameters and a correspondent sub-graph drawing program stored in the memory for drawing the sub-graph in the predetermined area according to the sub-graph parameters of the sub-graph. Each structural graph is formed by drawing all its sub-graphs one by one in the predetermined area. The sub-graph parameters of all the sub-graphs of each structural graph are kept in a graphic description file which is stored in the memory. One of the sub-graph parameters of each sub-graph is a target parameter. And the system further comprises an index table stored in the memory. The index table comprises a set of frequently used target parameters, an index number for each target parameter of the index table, and a special index number. All the target parameters and index numbers are stored in binary format in the memory. And the bit number of one index number is less than the bit number of one target parameter. Within the graphic description file, the target parameter of each sub-graph is changed by using the index table: if the target parameter is one of the frequently used target parameters, it is replaced by the correspondent index number of the target parameter; if the target parameter is not one of the frequently used target parameters, it is replaced by the special index number plus the target parameter.

It is an advantage of the present invention that the structural graph display system provides an index table which is used to reduce the size of the graphic description file so that the memory space needed for storing graphic information can be saved.

DETAILED DESCRIPTION OF THE PREFERRED EMBODIMENT

Figure 1:
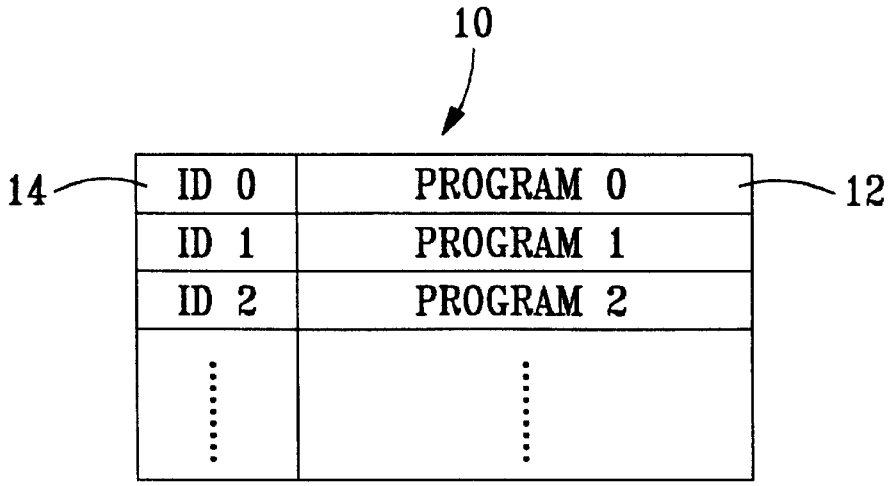
FIG. 1(PRIOR ART)
FIG. 1 shows the data structure of a prior art stroke table.
Figure 2:
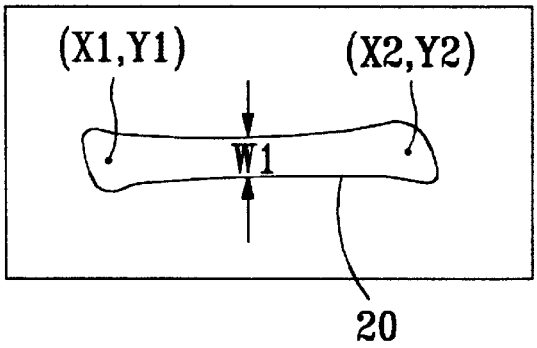
FIG. 2(PRIOR ART)
FIG. 2 shows the contour of a stroke and its control points and stroke width.
Figure 3:
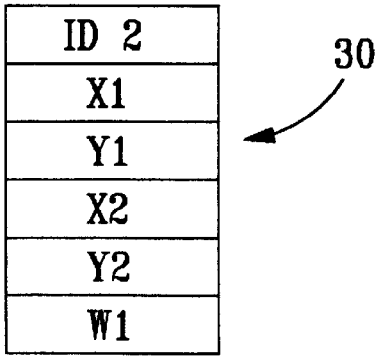
FIG. 3(PRIOR ART)
FIG. 3 shows a prior art stroke array of the stroke shown in FIG. 2.
Figure 4:
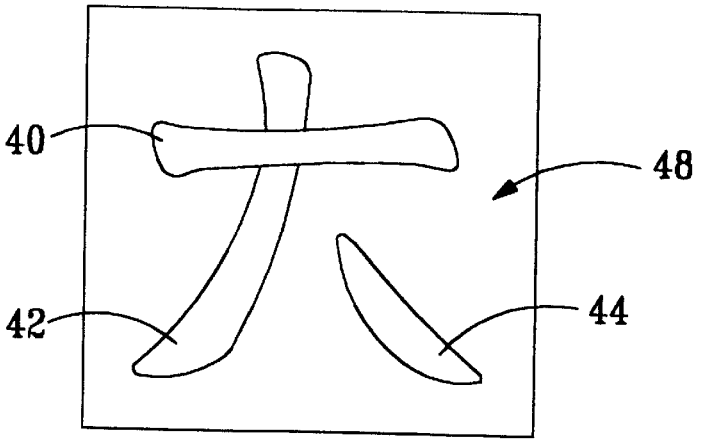
FIG. 4(PRIOR ART)
FIG. 4 shows the contour of a character which contains three strokes.
Figure 5:
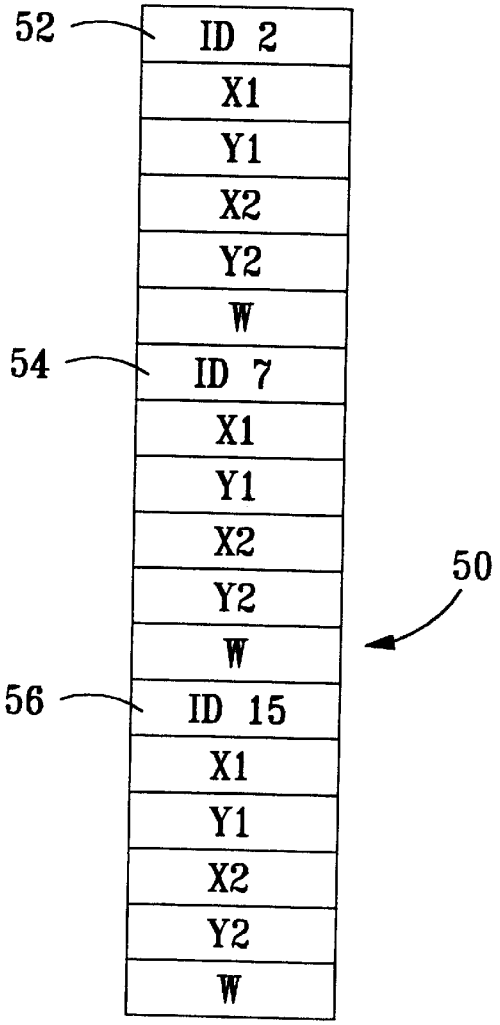
FIG. 5(PRIOR ART)
FIG. 5 shows a prior art character array of the character shown in FIG. 4.
Figure 7:
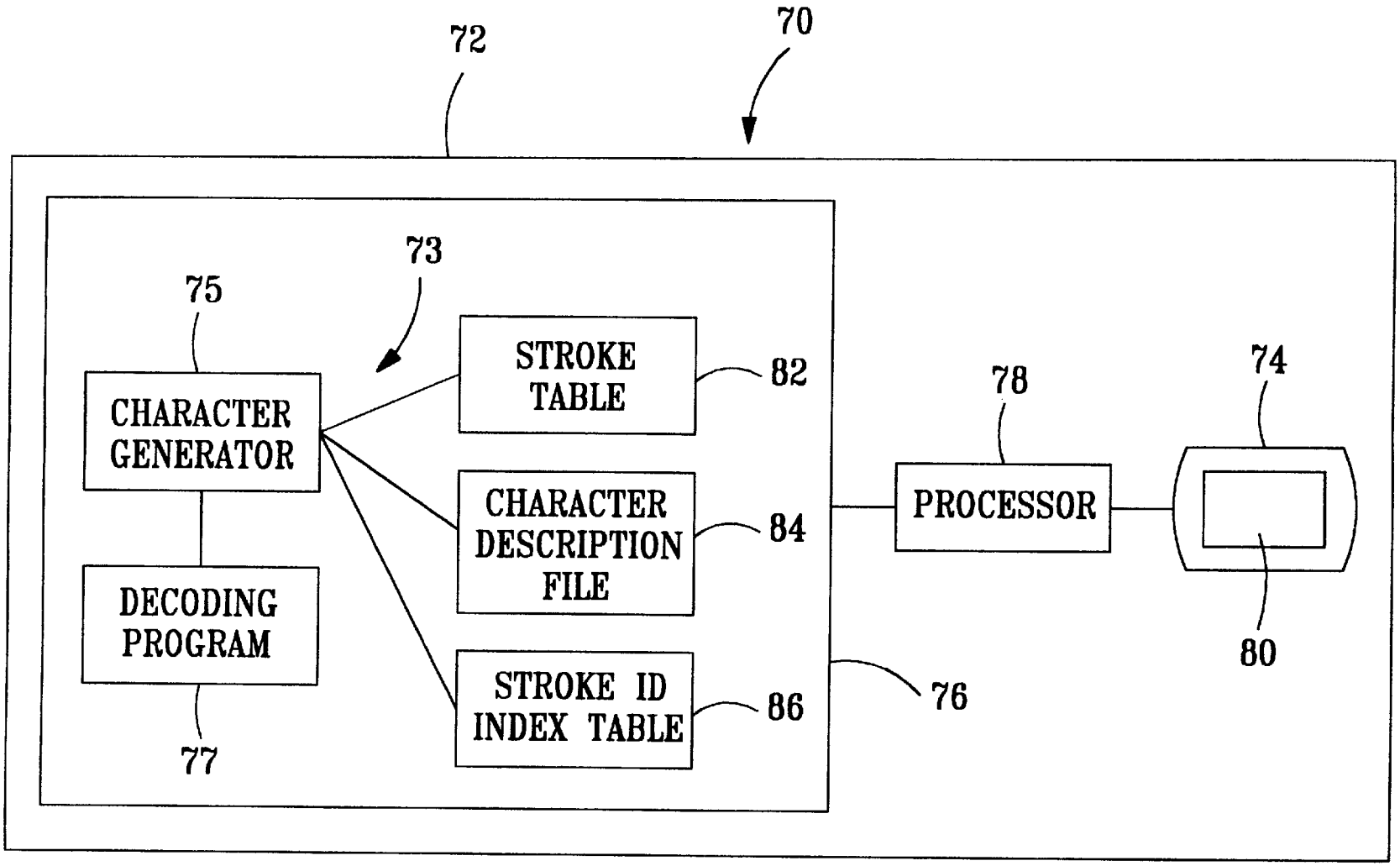
FIG. 7 is the block diagram of a structural graph display system according to the present invention.

Please refer to FIG. 7. FIG. 7 is the system block diagram of a structural graph display system 70 according to the present invention. System 70 comprises a computer 72 and a monitor 74. Computer 72 comprises a memory 76 for storing programs and data, and a processor 78 for executing the programs stored in memory 76. A character generation system 73 for generating characters is stored in the memory 76. System 73 includes a character generator 75, a decoding program 77 attached to the character generator 75, and three files: a character description file 84, a stroke table 10, and a stroke ID index table 86. The monitor 74 comprises a screen 80 which is used for displaying characters generated by the character generator 75 stored in the computer 72. The content of stroke table 10 is already shown in FIG. 1.

Figure 6:
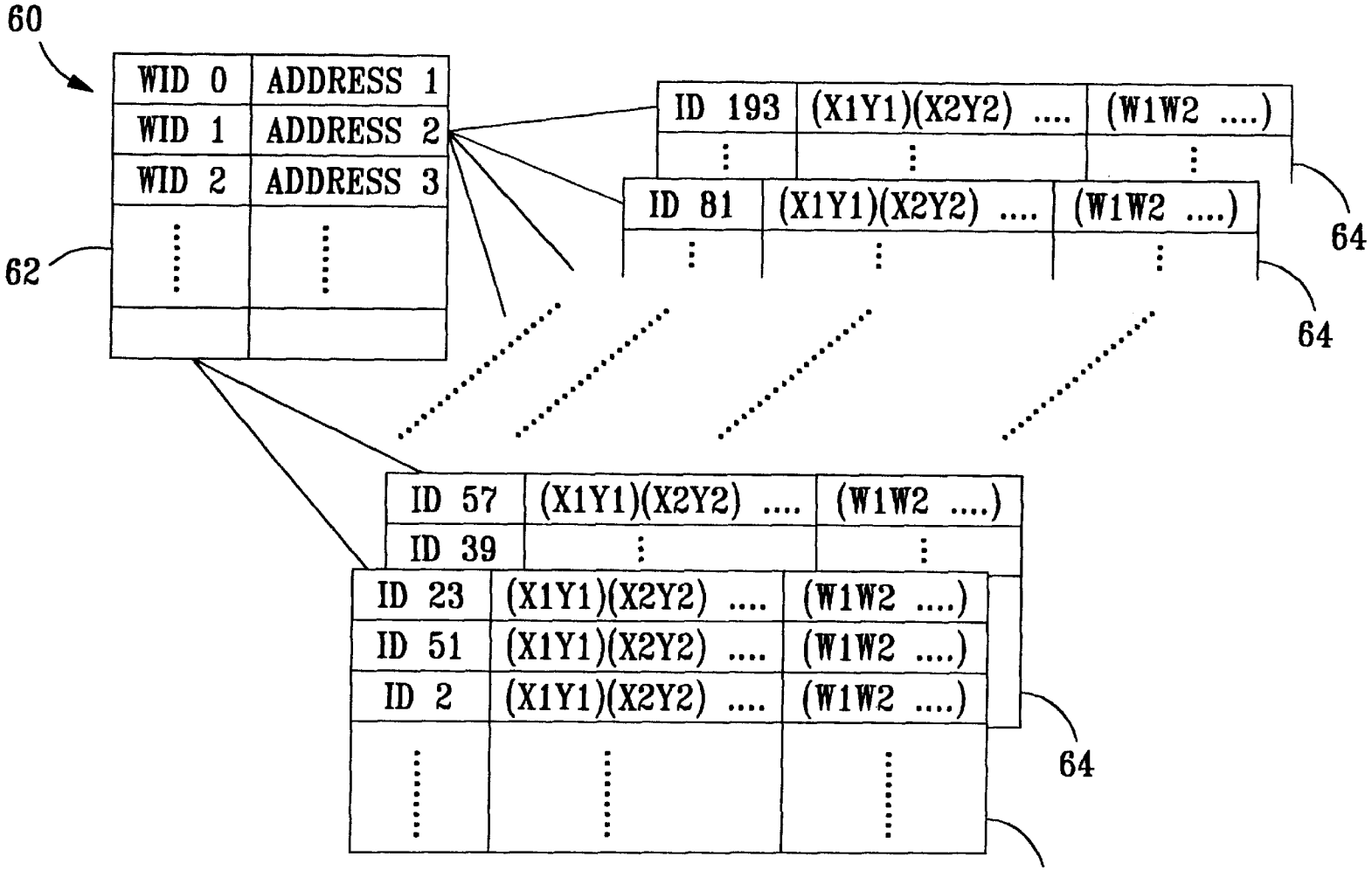
FIG. 6(PRIOR ART)
FIG. 6 shows a prior art character description file.
Figure 8:
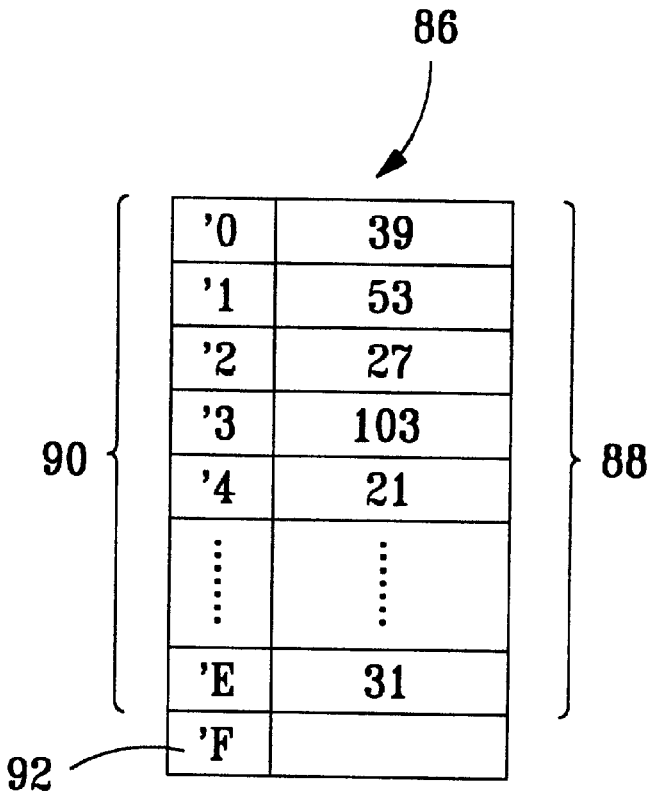
FIG. 8 shows a stroke ID index table according to the present invention.

Please refer to FIG. 8. FIG. 8 shows the content of the stroke ID index table 86. It contains fifteen most frequently used stroke IDs 88 which is obtained by analyzing all the stroke IDs contained in the character description file 60 shown in FIG. 6. Each stroke ID in the index table 86 has a correspondent index number 90. The index table 86 further comprises a special index number 92. All the stroke IDs 88 and index numbers 90 and 92 are stored in binary format in the memory 76 of the computer 72 shown in FIG. 7. And in the current example, each stroke ID uses eight bits to represent it, and each index number uses four bits since there are sixteen index numbers in the index table 86.

Figure 9:
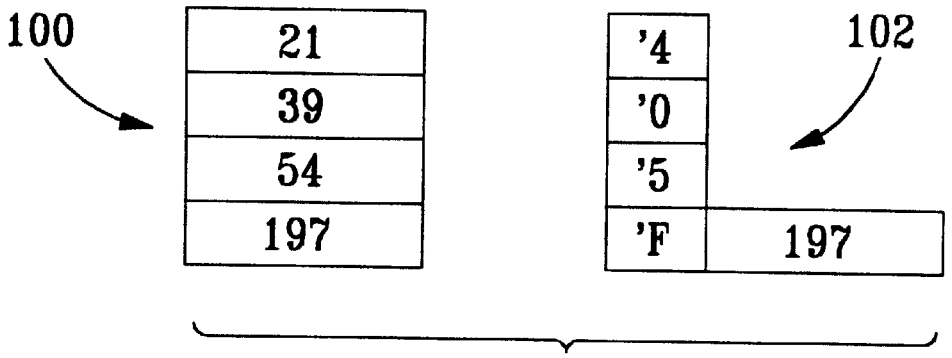
FIG. 9 shows an example of converting four stroke IDs into substitution codes by using the index table shown in FIG. 8.

Please refer to FIG. 9. FIG. 9 shows an example of replacing four stroke IDs 100 by using the index table 86. For each stroke ID 100, if it is the same as one of the most frequently used stroke IDs 88 contained in the index table 86, such as the stroke IDs 21, 39 and 54, it is replaced by its correspondent index number. But if it is not one of the most frequently used stroke IDs 88, such as the stroke ID 197, it is replaced by the special index number 92 plus its original stroke ID.

The content of the character description file 84 is the same as the character description file 60 except that all the stroke IDs in the character description file 60 are replaced by substitution codes, just as the example shown in FIG. 9. In this example, the four stroke IDs 100 takes 32 bits while the four substitution codes 102 uses 24 bits which leads to a 25% memory space saving. It can also be observed from this example that the rules of using one index table to reduce the size of one target graphic parameter (stroke ID) in order to reduce the overall memory space requirement of the character description file 60, can be summarized as below:

1. The more stroke IDs contained in the character description file 60 can be replaced by the index numbers of the most frequently used stroke IDs contained in the index table 86, the more saving in memory space can be obtained.
2. The less bit number used in one index number, e.g. using three bits instead of using four bits, the more saving in memory space can be obtained.

Less bit number used by one index number means the total number of most frequently used stroke IDs must be reduced. In the example shown in FIG. 9, if one index number uses only three binary bits, the total number of most frequently used stroke IDs must be reduced down to seven so that the total number of index numbers is eight.

The conversion of a substitution code back to its original data format is performed by the decoding program 77 shown in FIG. 7. When converting a substitution code, the decoding program 77 will first decide if the index number contained in the substitution code is the special index number 92. If it is, the special index number 92 will be deleted and the eight bits following the special index number 92 will be taken as the stroke ID. If the index number contained in the substitution code is not the special index number 92, the decoding program will locate the index file 86 and convert the index number back to its corresponding stroke ID stored in the index file 86.

The conversion process performed by the decoding program 77 will require some the calculation time of processor 78. In fact, the memory saving technique which uses index number to replace most frequently used stroke IDs is a technique which uses CPU calculation time to save memory space. In other words, the index table and substitution codes can save memory space required for storing the prior art character description file 60 while it requires CPU calculation time to convert each substitution code back to a stroke ID. But since modern CPU calculation speed is very fast and in most cases users can't feel the difference. Since memory capacity is much limited in small electronic system which equips with a Chinese character generator, such technique may help a lot in reducing the size of the character description files used by the Chinese character generator so that multiple Chinese fonts can be packed into such a system.

Figure 10:
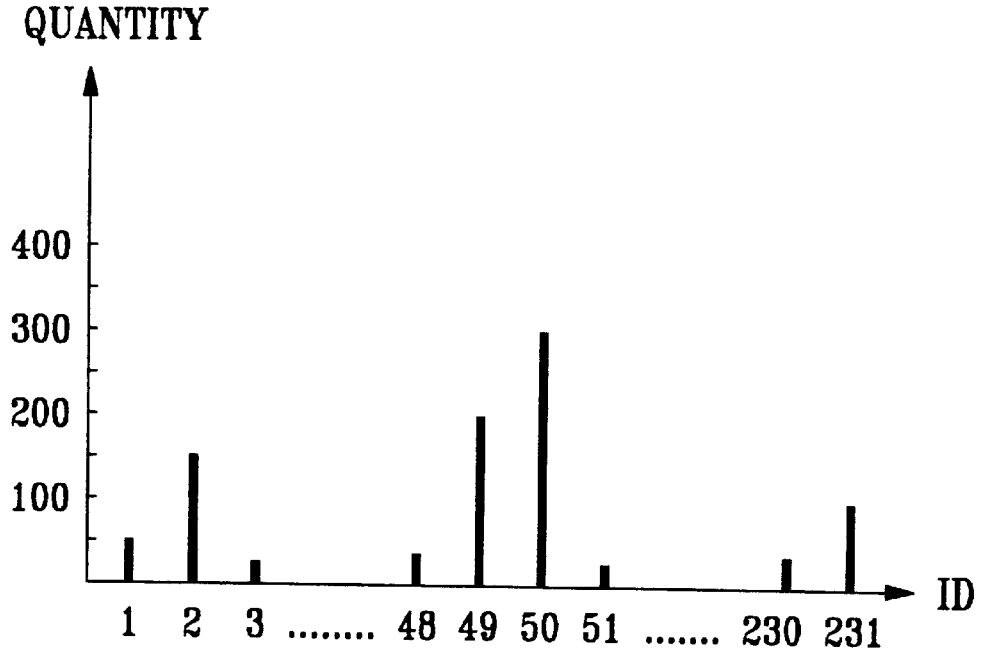
FIGS.10 and 11 show the numbers of occurrences of each stroke ID in different sequences.
Figure 11:
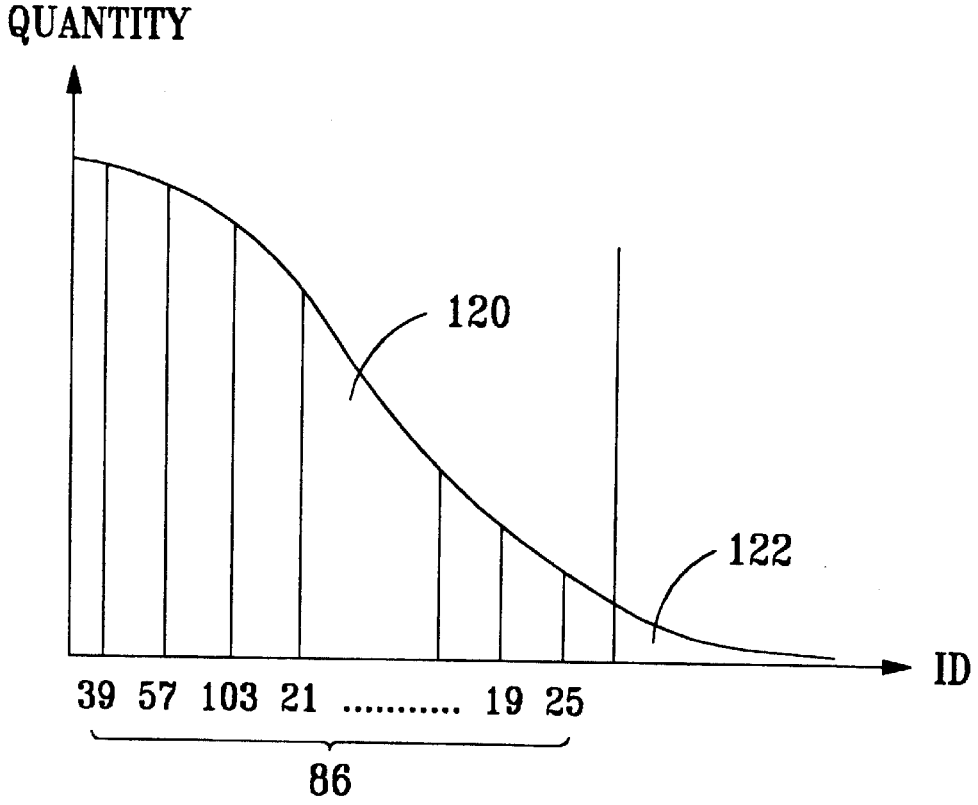

Please refer to FIGS. 10 and 11. FIGS. 10 and 11 show how the most frequently used stroke IDs 88 of the index table 86 shown in FIG. 8 are generated. FIG. 10 shows the numbers of occurrences of each stroke ID contained in the character description file 60, and FIG. 11 is the same as FIG. 10 except that the positions of all the stroke IDs are arranged according to the amounts of their individual occurrence numbers in the character description file 60. The left most fifteen stroke IDs are selected as the most frequently used stroke IDs which are listed in the index table 86.

A basic requirement for using the indexing technique disclosed in the present invention is that the size of the character description file 84 should be smaller than the prior art character description file 60. This can be illustrated by using FIG. 11. In FIG. 11, if the area 120 is much larger than the area 122, that means most stroke IDs contained in the character description file 60 can be replaced by the index numbers of the fifteen most frequently used stroke IDs, and only a small portion of the stroke IDs can not be replaced. In this case most 8-bit stroke IDs are replaced by using 4-bit index number and only a small portion of the stroke IDs become 12-bit substitution codes (4-bit index number plus 8-bit stroke ID). Memory space required to store the character description file 60 is substantially reduced by converting most 8-bit stroke IDs into 4-bit index numbers. The bigger the difference between the areas 120 and 122, the more memory space can be saved by using the index technique of the present invention.

In a stroke array, other stroke parameter such as stroke width or stroke color can also use the above described indexing technique to further reduce the size of the prior art character description file 60.

Figure 12:
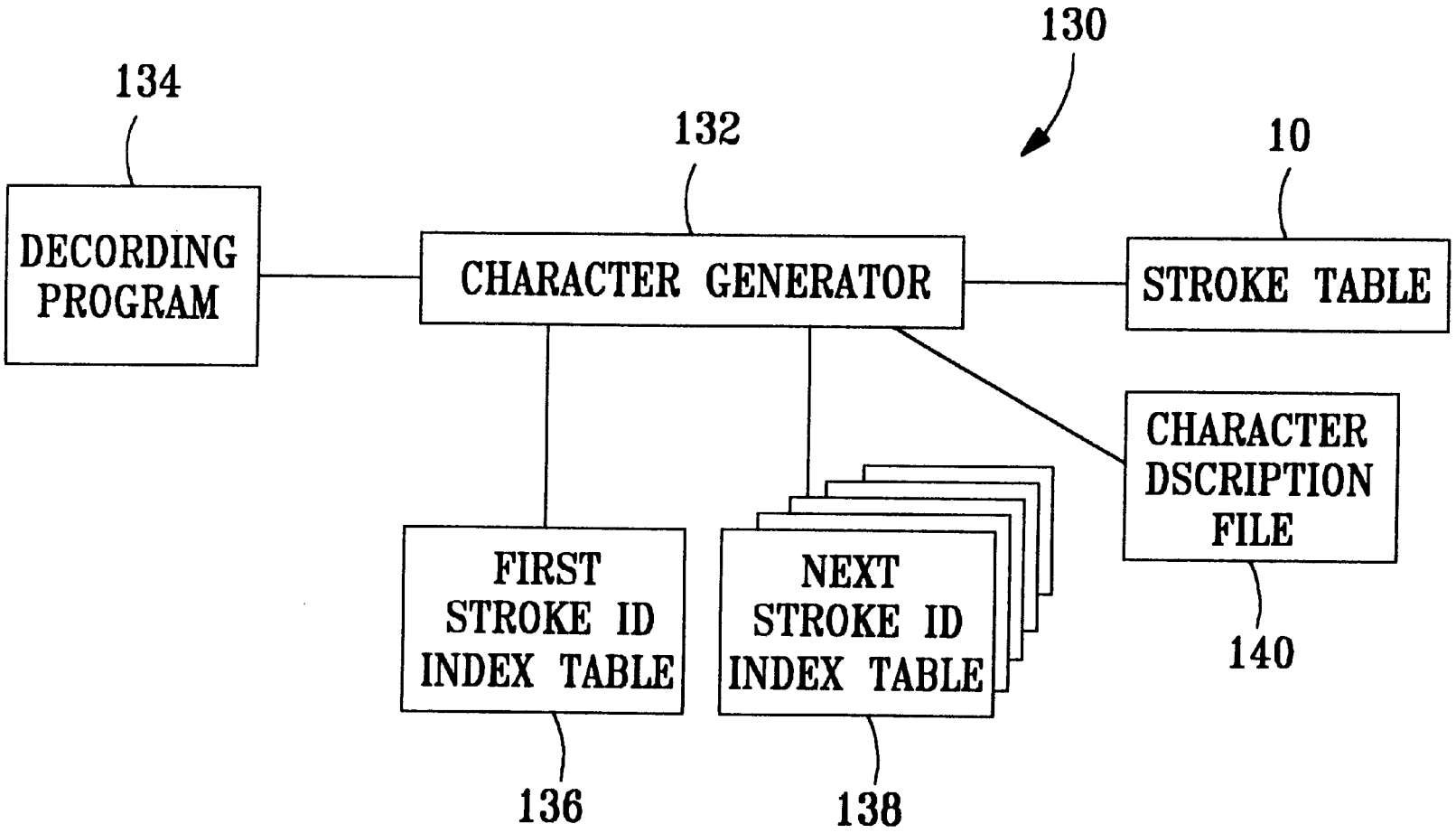
FIG. 12 shows an alternative character generation system according to the present invention.

Please refer to FIG. 12. FIG. 12 shows another character generation system 130 for generating characters according to the present invention. System 130 comprises a character generator 132, a decoding program 134 attached to the character generator 132, and a plurality of data files: a stroke table 10, a character description file 140, a first stroke ID index table 136, and a next stroke ID index table 138 for each stroke ID contained in the stroke table 10. The content of stroke table 10 is already shown in FIG. 1.

In the prior art character description file 60, all the stroke arrays contained in each character array are arranged in a predetermined drawing sequence which is similar to the hand writing sequence of each Chinese character. The leading stroke in a drawing sequence is called first stroke, and the immediately following stroke of each stroke appears in a drawing sequence is called next stroke. In other words, all the strokes except for the leading stroke in a drawing sequence can be classified as next strokes.

After analyzing all the first strokes contained in the prior art character description file 60, it is interesting to realize that certain strokes are frequently used as the first strokes of all the Chinese character. The first stroke ID index table 136 contains fifteen most frequently used first stroke IDs. Besides, after analyzing all the drawing sequences contained in the character description file 60 about all the next stroke IDs following a specific stroke ID, it is interesting to realize that there are always some strokes appear very frequently after each stroke ID. And in the next stroke ID index table 138 of one specific stroke ID, it lists fifteen most frequently used next stroke IDs of the specific stroke ID.

The difference between the character description file 140 and the prior art character description file 60 is that all the first stroke IDs contained in the character description file 60 are replaced by using the first index table 136. And each stroke ID's next stroke ID contained in all the drawing sequences of the character description file 60 is replaced by using its next stroke ID index table 138.

The conversion method for converting all the first and next stroke IDs contained in the character description file 60 into substitution codes by using the index tables 136 or 138 is the same as the method described in FIG. 9. If the stroke ID is the same as one of the most frequently used stroke IDs contained in the related index table, it is replaced by its correspondent index number. But if the stroke ID is not one of the most frequently used stroke IDs, it is replaced by the special index number contained in the related index table plus its original stroke ID.

When drawing a Chinese character, the decoding program 134 will convert the substitution code of the first stroke contained in the character array of the Chinese character back into its original stroke ID by using the first stroke ID index table 136. And the substitution code of each stroke's next stroke ID will also be converted back by using each stroke's next stroke ID index table 138.

All the first stroke IDs or next stroke IDs of the character description file 60 can be converted separately. For example, the character description file 140 may convert all the next stroke IDs into substitution codes while keep all the first stroke ID. Various combinations of the indexing techniques can be formed according to various application requirements.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A structural graph display system comprising a memory for storing programs and data, a processor for executing the programs stored in the memory, and a predetermined area for displaying a structural graph; each structural graph being formed by at least one sub-graph, each sub-graph comprising a plurality of sub-graph parameters and a correspondent sub-graph drawing program stored in the memory for drawing the sub-graph in the predetermined area according to the sub-graph parameters of the sub-graph, each structural graph being formed by drawing all its sub-graphs one by one in the predetermined area; the sub-graph parameters of all the sub-graphs of each structural graph being kept in a graphic description file which is stored in the memory;

characterized in:

one of the sub-graph parameters of each sub-graph being a target parameter, and the system further comprising an index table stored in the memory, the index table comprising a set of frequently used target parameters, an index number for each target parameter of the index table, and a special index number, all the target parameters and index numbers being stored in binary format in the memory, and the bit number of one index number being less than the bit number of one target parameter; and within the graphic description file, the target parameter of each sub-graph being changed by using the index table: if the target parameter is one of the frequently used target parameters, it is replaced by the correspondent index number of the target parameter; if the target parameter is not one of the frequently used target parameters, it is replaced by the special index number plus the target parameter.

2. The structural graph display system of claim 1 wherein the predetermined area is a computer screen.

3. The structural graph display system of claim 1 wherein the structural graph is a character formed by at least one stroke and each stroke defines a sub-graph of the character.

4. The structural graph display system of claim 3 wherein each stroke comprises a stroke ID (identification), at least one control point and at least one stroke width which define the sub-graph parameters of the stroke.

5. The structural graph display system of claim 4 wherein the target parameter of each stroke is the stroke ID.

6. The structural graph display system of claim 1 wherein the set of frequently used target parameters; of the index table are a predetermined number of the target parameters appear most frequently in all target parameters stored in the graphic description file.

7. A structural graph display system comprising a memory for storing programs and data, a processor for executing the programs stored in the memory, and a predetermined area for displaying a structural graph; each structural graph being formed by at least one sub-graph, each sub-graph comprising a plurality of sub-graph parameters and a correspondent sub-graph drawing program stored in the memory for drawing the sub-graph in the predetermined area according to the sub-graph parameters of the sub-graph, each structural graph being formed by drawing all its sub-graphs one by one in the predetermined area; the sub-graph parameters of all the sub-graphs of each structural graph being kept in a graphic description file which is stored in the memory;

characterized in:

one of the sub-graph parameters of each sub-graph being a target parameter, and each sub-graph of the system further comprising a sub-graph index table stored in the memory, the index table comprising a set of frequently used target parameters, an index number for each target parameter of the index table, and a special index number, all the target parameters and index numbers being stored in binary format in the memory, and the bit number of one index number being less than the bit number of one target parameter; and within the graphic description file, the target parameter of each sub-graph being changed by using the index table: if the target parameter is one of the frequently used target parameters, it is replaced by the correspondent index number of the target parameter; if the target parameter is not one of the frequently used target parameters, it is replaced by the special index number plus the target parameter.

8. The structural graph display system of claim 7 wherein the structural graph is a character formed by at least one stroke and each stroke defines a sub-graph of the character.

9. The structural graph display system of claim 8 wherein each stroke comprises a stroke ID, at least one control point and at least one stroke width which define the sub-graph parameters of the stroke.

10. The structural graph display system of claim 8 wherein the target parameter of each stroke is the stroke ID.

11. The structural graph display system of claim 7 wherein the set of frequently used target parameters of the index table are a predetermined number of the target parameters appear most frequently in all target parameters stored in the graphic description file.

12. A structural graph display system comprising a memory for storing programs and data, a processor for executing the programs stored in the memory, and a predetermined area for displaying a structural graph; each structural graph being formed by at least one sub-graph, each sub-graph comprising a plurality of sub-graph parameters and a correspondent sub-graph drawing program stored in the memory for drawing the sub-graph in the predetermined area according to the sub-graph parameters of the sub-graph, each structural graph being formed by drawing all its sub-graphs one by one according to a predetermined drawing sequence in the predetermined area; within the drawing sequence, a next sub-graph of a designated sub-graph being defined as the immediately following sub-graph of the designated sub-graph in the drawing sequence, and a former sub-graph of the designated sub-graph being defined as the immediately preceding sub-graph of the designated sub-graph in the drawing sequence; the sub-graph parameters of all the sub-graphs of each structural graph being kept in a graphic description file which is stored in the memory;

characterized in:

one of the sub-graph parameters of each sub-graph being defined as a target parameter, and the system further comprising a next sub-graph index table for each sub-graph, the index table comprising a set of frequently used target parameters of all the next sub-graphs of the sub-graph, an index number for each target parameter of the index table, and a special index number, all the target parameters and index numbers being stored in binary format in the memory, and the bit number of one index number being less than the bit number of one target parameter; and within the graphic description file, the target parameter of each next sub-graph of the drawing sequence of each structural graph being changed by using the next sub-graph index tables: if the target parameter of one next sub-graph is one of the frequently used target parameters contained in the index table of the former sub-graph of the next sub-graph, it is replaced by the correspondent index number of the target parameter; if the target parameter is not one of the frequently used target parameters, it is replaced by the special index number plus the target parameter.

13. The structural graph display system of claim 12 wherein the structural graph is a character formed by at least one stroke and each stroke defines a sub-graph of the character.

14. The structural graph display system of claim 13 wherein the target parameter of each stroke is a stroke ID of the stroke.

15. The structural graph display system of claim 12 wherein a first sub-graph of one structural graph is defined as the first sub-graph in the drawing sequence of the structural graph, and the system further comprises a first sub-graph index table stored in the memory, the index table comprising a set of frequently used target parameters of all the first sub-graphs stored in the graphic description file, an index number for each target parameter of the index table, and a special index number, all the target parameters and index numbers being stored in binary format in the memory, and the bit number of one index number being less than the bit number of one target parameter; and within the graphic description file, the target parameter of the first sub-graph of each structural graph is changed by using the first sub-graph index table: if the target parameter of the first sub-graph is one of the frequently used target parameters contained in the index table, it is replaced by the correspondent index number of the target parameter; if the target parameter is not one of the frequently used target parameters, it is replaced by the special index number plus the target parameter.

16. A structural graph display system comprising a memory for storing programs and data, a processor for executing the programs stored in the memory, and a predetermined area for displaying a structural graph; each structural graph being formed by at least one sub-graph, each sub-graph comprising a plurality of sub-graph parameters and a correspondent sub-graph drawing program stored in the memory for drawing the sub-graph in the predetermined area according to the sub-graph parameters of the sub-graph, each structural graph being formed by drawing all its sub-graphs one by one according to a predetermined drawing sequence in the predetermined area; a first sub-graph of one structural graph being defined as the first sub-graph in the drawing sequence of the structural graph; the sub-graph parameters of all the sub-graphs of each structural graph being kept in a graphic description file which is stored in the memory;

characterized in:

one of the sub-graph parameters of each sub-graph being defined as a target parameter, and the system further comprising a first sub-graph index table stored in the memory, the index table comprising a set of frequently used target parameters of all the first sub-graphs stored in the graphic description file, an index number for each target parameter of the index table, and a special index number, all the target parameters and index numbers being stored in binary format in the memory, and the bit number of one is index number being less than the bit number of one target parameter; and within the graphic description file, the target parameter of the first sub-graph of each structural graph being changed by using the first sub-graph index table: if the target parameter of the first sub-graph is one of the frequently used target parameters contained in the index table, it is replaced by the correspondent index number of the target parameter; if the target parameter is not one of the frequently used target parameters, it is replaced by the special index number plus the target parameter.

17. The structural graph display system of claim 16 wherein the structural graph is a character formed by at least one stroke and each stroke defines a sub-graph of the character.

18. The structural graph display system of claim 17 wherein the target parameter of each stroke is a stroke ID of the stroke.

19. The structural graph display system of claim 16 wherein within each drawing sequence, a next. sub-graph of a designated sub-graph is defined as the immediately following sub-graph of the designated sub-graph in the drawing sequence, and a former sub-graph of the designated sub-graph is defined as the immediately preceding sub-graph of the designated sub-graph in the drawing sequence;

the system further comprises a next sub-graph index table for each sub-graph, the next sub-graph index table comprising a set of frequently used target parameters of all the next sub-graphs of the sub-graph, an index number for each target parameter of the index table, and a special index number, all the target parameters and index numbers of the index table being stored in binary format in the memory, and the bit number of one index number being less than the bit number of one target parameter of the index table; and within the graphic description file, the target parameter of each next sub-graph of the drawing sequence of each structural graph is changed by using the next sub-graph index tables: if the target parameter of the next sub-graph is one of the frequently used target parameters contained in the next sub-graph index table of the former sub-graph of the next sub-graph, it is replaced by the correspondent index number of the target parameter; if the target parameter is not one of the frequently used target parameters, it is replaced by the special index number plus the target parameter.

20. The structural graph display system of claim 19 wherein the set of frequently used target parameters of the next sub-graph index table of one sub-graph are a predetermined number of the target parameters appear most frequently in all target parameters of the next sub-graphs of the sub-graph stored in the graphic description file.

* * * * *